United States Patent [19]

Wadatsu

[11] Patent Number: 4,649,789

[45] Date of Patent: Mar. 17, 1987

[54] TUNING APPARATUS FOR STRINGED MUSICAL INSTRUMENT

[75] Inventor: Keiji Wadatsu, Shizuoka, Japan

[73] Assignee: Nippon Gakki Seizo Kabushiki Kaisha, Hamamatsu, Japan

[21] Appl. No.: 769,613

[22] Filed: Aug. 26, 1985

[51] Int. Cl.[4] ..... G10D 3/04

[52] U.S. Cl. ..... 84/298; 84/297 R; 84/312 R

[58] Field of Search ..... 84/200–203, 84/267, 298, 299, 312 R, 312 P, 455, 297 R

[30] Foreign Application Priority Data

Sep. 11, 1984 [JP] Japan ..... 59-136725

[56] References Cited

U.S. PATENT DOCUMENTS 4,366,740 1/1983 Tripp ..... 84/298

4,506,585 3/1985 Desmond ..... 84/298

4,572,049 2/1986 Tanaka et al. ..... 84/298 X

*Primary Examiner*—Benjamin R. Fuller

*Attorney, Agent, or Firm*—Blakely, Sokoloff, Taylor & Zafman

[57] ABSTRACT

A tuning apparatus for a stringed musical instrument includes a bridge base, a plurality of bridges, a plurality of anchor members of the same number as that of the bridges, and tuning bolts of the same number as that of the bridges or anchor members. The bridge base is fixed on a body. Each bridge is mounted on an upper surface of a front end portion of the bridge base and is movable along vertical and back-and-forth directions with respect to the body. Each bridge supports one end portion of a string at a top surface thereof. Each anchor member is mounted on an upper surface of a rear end portion of the bridge base and is movable along the back-and-forth direction. Each anchor member locks a bead coupled to one end of the string. Each tuning bolt is rotated to move the corresponding anchor member along the back-and-forth direction. The upper surface of the rear end portion of the bridge base is provided with a guide for guiding the corresponding anchor member, and the guide is inclined at the same angle as a holding angle at one end portion of the string.

7 Claims, 4 Drawing Figures

TUNING APPARATUS FOR STRINGED MUSICAL INSTRUMENT

BACKGROUND OF THE INVENTION

The present invention relates to a simple tuning apparatus for a stringed musical instrument, wherein anchor members for tuning can be smoothly and easily moved and adjusted with a small operation force to improve operability.

Various tuning apparatuses for stringed musical instruments such as guitars have been proposed. A typical example in which tuning operation is done at a tail side of the guitar is described in Japanese Patent Prepublication No. 59-15987. According to this tuning apparatus, a bead coupled at one end of a string is locked by an anchor member and the anchor member is moved back-and-forth by a tuning knob in a tuning block. In this case, since the bead is fitted in a recess formed in the anchor member to lock one end of the string, the string can be easily fitted to or replaced with a new one when it is broken. However, the bridges and the tuning block are separately provided, and the number of components is increased, resulting in cumbersome assembly. During assembly, the string is curved due to variations in components and positioning errors and the turning knob cannot be smoothly moved, resulting in inconvenience. A string portion between the bridge and the block is inclined at a proper angle (i.e., a holding angle) toward the body so as to define one end of the speaking length of the string, while the anchor member is substantially parallel to the surface of the body. Tension of the string exerts force on the anchor member so as to raise it up. As a result, knob movement becomes stiffer.

SUMMARY OF THE INVENTION

It is, therefore, a principal object of the present invention to provide a simple tuning apparatus for a stringed musical instrument, which has a small number of components and can be easily assembled.

It is another object of the present invention to provide a tuning apparatus for a stringed musical instrument, wherein a tuning bolt can be operated with a small force.

In order to achieve the above object of the present invention, there is provided a tuning apparatus for a stringed musical instrument, comprising: a bridge base fixed on a body; a bridge mounted on an upper surface of a front end portion of the bridge base and movable along vertical and back-and-forth directions, the bridge being arranged to support one end portion of a string at a top surface thereof; an anchor member mounted on an upper surface of a rear end portion of the bridge base and movable along the back-and-forth direction, the anchor member being arranged to lock a bead coupled to one end of the string; and a tuning bolt for moving the anchor member along the back-and-forth direction, the upper surface of the rear end portion of the bridge base being provided with a guide for guiding the anchor member, the guide being inclined at the same angle as a holding angle at one end portion of the string.

DESCRIPTION OF THE PREFERRED EMBODIMENT

Figure 1:
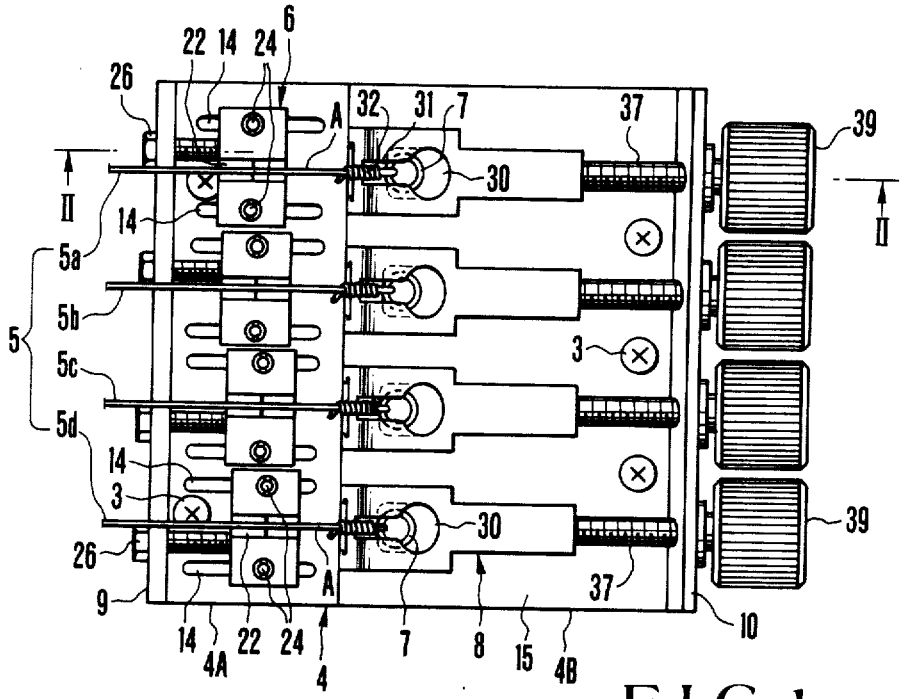
FIG. 1 is a plan view of a tuning apparatus for an electric guitar according to an embodiment of the present invention.
Figure 3:
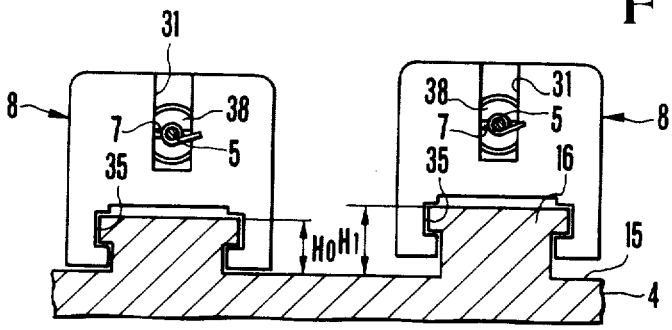
FIG. 3 is an enlarged sectional view showing the main part of the tuning apparatus of FIG. 1.
Figure 2:
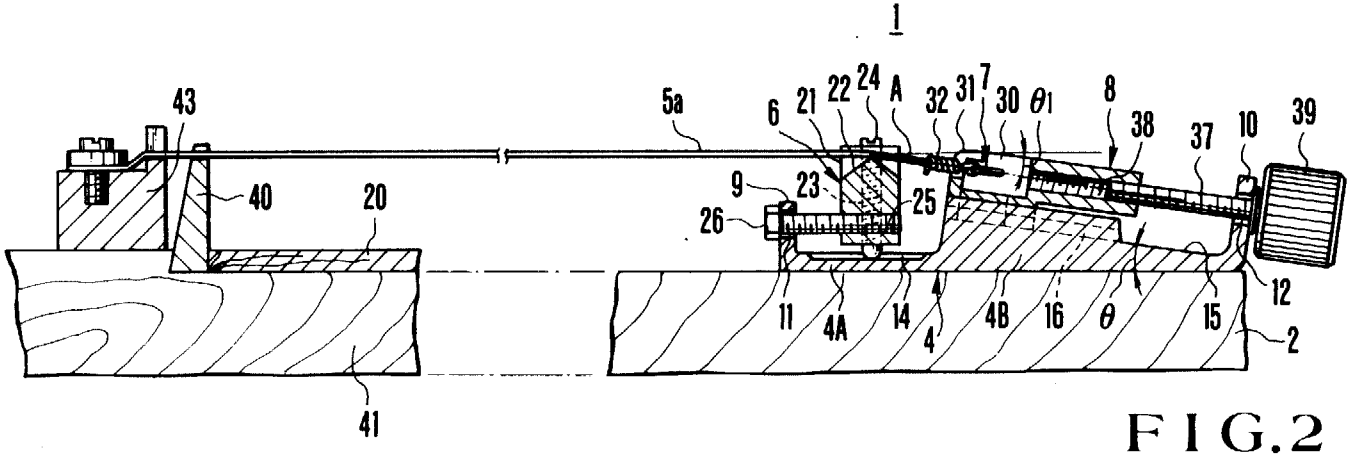
FIG. 2 is a sectional view of the tuning apparatus of FIG. 1 taken along the line II—II thereof together with a neck structure.

FIG. 1 is a plan view of a tuning apparatus for an electric guitar as a stringed musical instrument according to an embodiment of the present invention, FIG. 2 is a sectional view thereof taken along the line II—II of FIG. 1 together with a neck structure, and FIG. 3 is an enlarged sectional view showing the main part of the tuning apparatus of FIG. 1. Referring to FIGS. 1 to 3, a tuning apparatus 1 has a bridge base 4 fixed by a plurality of set screws 3 to a body 2. Bridges 6 and anchor members 8 are mounted on the bridge base 4 in correspondence with strings 5 (5*a* to 5*d*). Each bridge 6 supports one end of a corresponding one of the strings 5 and each anchor member 8 locks a bead 7 fixed to one end of the corresponding string 5. This embodiment exemplifies a bass guitar with four strings. When the number of bridges 6 and anchor members 8 is increased, the present invention can be applied to a 6-string guitar. The other end of each string 5 is fixed through a nut 40 by a fixing mechanism 43 at the distal end of a neck 41, as shown in FIG. 2.

The bridge base 4 comprises a plate member. Front and rear walls 9 and 10 are integrally formed at the front and rear ends of the bridge base 4, respectively. The front and rear walls 9 and 10 extend upward and constitute bolt mounting portions. Vertically elongated horizontal through holes 11 respectively corresponding to the bridges 6 are formed in the front wall 9. Similarly, tuning bolt through holes 12 respectively corresponding to the anchor members 8 are formed in the rear wall 10. A front $\frac{1}{3}$ portion 4A of the bridge base 4 is thin and flat. A pair of right and left guide grooves 14 for each bridge 6 are formed on the flat portion of the bridge base 4, so that a total of eight guide grooves 14 extend along the extension direction of the strings 5. The pair of right and left guide grooves 14 are parallel with each other and substantially symmetrical about the corresponding string. A remaining rear portion 4B of the bridge base 4 is inclined downward from the rear end of the front portion 4A and reaches the rear wall 10. The longitudinal section of the rear portion 4B constitutes substantially a right-angled triangle. The upper surface of the rear portion 4B constitutes an inclined surface 15 whose extended surface crosses the upper surface of the body 2 at a proper angle $\theta$. Guides 16 for the anchor members $\theta$ are integrally formed in the front portion of the inclined surface 15 as parallel to the surface 15, respectively. The guides 16 are also inclined with the same angle 8 as the inclined surface 15. The guide 16 guides the corresponding anchor member 8 along the back-and-forth direction. The guide 16 has a substantially T-shaped cross section as shown in FIG. 3 and extends along the extension direction of the string 5. Since a height difference $\Delta H$ between the first or fourth string 5*a* or 5*d* and the second or third string 5*b* or 5*c* is present due to a curved central portion of a fingerboard 20 on the neck 41, the height of the guides 16 for the second and third strings 5*b* and 5*c* is different from that of the guides 16 for the first and fourth strings 5*a* and 5*d*.

More specifically, a height H1 of the inner guides 16 for the second and third strings 5b and 5c is higher by the difference ΔH than a height H0 of the end guides 16 for the first and fourth strings 5a and 5d (See FIG. 3).

The bridge 6 is formed in a prism shape and is disposed on the front portion 4A of the bridge base 4. A substantially inverted V-shaped groove 21 is formed in the upper surface of the bridge 6, so that a string seat projection 22 is formed at the top of the bridge 6. One end portion of the corresponding string 5 is supported by the top of the string seat projection 22. A pair of vertical screw holes 23 vertically extending through each bridge 6 are formed at two ends thereof. Height adjusting screws 24 are threadably engaged with the holes 23, respectively. The lower ends of the screws 24 are engaged in the corresponding pair of guide grooves 14 formed in the front portion 4A of the bridge base 4 and are urged downward by the string pressure. When the height adjusting screws 24 are selectively rotated by a screwdriver or the like, the corresponding bridge 6 is vertically moved and the height of the string 5 is adjusted. The bridges 6 are coupled to the front walls 9 of the bridge base 4 through corresponding pitch bolts 26. Each pitch bolt 26 is threadably engaged with a screw hole 25 of the corresponding bridge 6 through a bolt insertion hole 11 of the wall 9. When the bolt 26 is rotated, the bridge 6 is moved in the back-and-forth direction to adjust the octave pitch of the corresponding string 5. During this operation, the height adjusting screws 24 are moved along the corresponding guide grooves 14.

The anchor members 8 extend along the longitudinal direction of the body. Holes 30 and notches 31 are formed in the upper surfaces of the front ends of the anchor members 8, respectively. Each hole 30 is a portion for locking the corresponding bead 7 coupled to one end of the corresponding string 5. Each notch 31 communicates with the corresponding hole 30 and extends forward therefrom. The width of each notch 31 is smaller than a diameter of the corresponding bead 7 but is slightly larger than a diameter (i.e., a diameter of an ornamental string portion 32) of an end portion of the string which is locked at the bead 7. The ornamental string is wound by the string 5 itself after the string is inserted in the corresponding bead 7. More particularly, the ornamental string portion 32 is inserted in the corresponding notch 31 from the top to prevent rotation of the string 5 itself and removal of the bead 7. In this case, the bead 7 is vertically inserted in the hole 30 and prevented from slipping out of the notch 31.

Substantially T-shaped recesses 35 as shown in FIG. 3 are formed at the front lower portions of the anchor members 8, respectively. The guides 16 are fitted in the recesses 35, respectively, so that the anchor members 8 can be moved along the back-and-forth direction as guided by the guides 16. Transverse and upward movement of the anchor members 8 is prevented by guiding by means of the guides 16 and the recesses 35. The anchor members 8 are inclined at the same angle as that ($\theta$) of the inclined surface 15. In this case, the inclined angle $\theta$ of the inclined surface 15 is the same ($\theta=\theta 1$) as an angle (i.e., an angle of about 7° at which a string portion A between the string seat projection 22 and the bead 7 is inclined with respect to an effective vibration string portion) of the string portion A.

The anchor members 8 are coupled to the rear wall 10 by tuning bolts 37. The tuning bolts 37 are respectively inserted in bolt insertion holes 12 formed in the rear wall 10 and are threadably engaged with screw holes 38 formed in the rear portions of the anchor members 8. The tuning bolts 8 are integrally formed at the rear end portions with operation knobs 39, respectively. When each operation knob 39 is rotated by hand, the corresponding anchor member 8 is guided by the guide 16 and moved along the back-and-forth direction, thereby adjusting the tension force of the string 5. A central axis line of the tuning bolt 37 and the center axis of the string portion A of the corresponding string 5 are aligned in line by adjusting the height of the bridge 6. This construction is very important to prevent the anchor member 8 from receiving rotational force from the tension of the string 5. Since the inclined angle $\theta$ of the inclined guide 16 is substantially the same as that $\theta 1$ of the string 5, the inclined angle of the string 5 is not changed even if the corresponding anchor member 8 is moved in the back-and-forth direction. The anchor member 8 is thus free from the rotational force. An excessive force will not act on the anchor member 8, and the tuning bolt 37 will not locally contact the corresponding bolt through hole 12. As a result, the operation knob 39 can be smoothly rotated.

The rear wall 10 is preferably formed to be perpendicular to the tuning bolts 37.

In the above embodiment, the hole 30 is used as the locking portion of the bead 7. However, the locking portion is not limited to the hole. A projection for mounting the bead 7 may be used in place of the hole 30. In this case, the projection prevents rotational movement of the bead 7, so that the notch 31 can be omitted.

Figure 4:
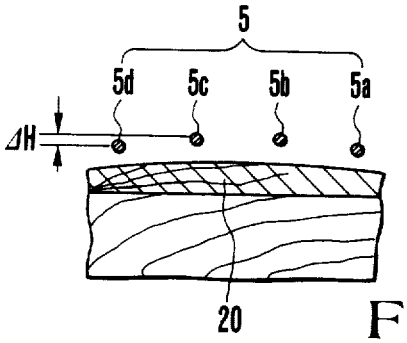
FIG. 4 is a sectional view showing the relationship between the fingerboard and the strings.

In the above embodiment, the central portion of the upper surface of the fingerboard 20 is curved, as described with reference to FIG. 4. However, the upper surface of the fingerboard 20 may be flattened. In this case, the heights of the guides 16 are identical.

In the tuning apparatus for a stringed musical instrument according to the present invention, bridges each supporting one end portion of each of the strings and anchor members each locking one of the beads of the strings are disposed on the bridge base. Unlike in the conventional tuning apparatus having separate bridges and the tuning block disposed anchor members, the number of components can be decreased, and the tuning block and bridges need not be separately positioned, thereby simplifying the assembly operation and preventing misalignment of the bridges with the tuning block and bending of the strings.

The inclined surface of the anchor members of the bridge base has the same angle as the holding angle of the string. At the same time, the center axis of each tuning bolt for adjusting the corresponding anchor member is aligned with the center axis of the string portion bent at the holding angle. An excessive tension force will not act on the anchor members and tuning bolts, and thus the tuning bolts can be smoothly rotated, thereby facilitating tuning operation. Furthermore, since the anchor members are slidably fitted on the guides disposed on the inclined surface, undesired transverse and upward movement of the anchor members is prevented, thus providing many industrial advantages.

What is claimed is:

1. A tuning apparatus for a stringed musical instrument, comprising:

a bridge base fixed on a body having a longitudinal axis;

a bridge mounted on an upper surface of a front end portion of said bridge base and movable along vertical directions with respect to said longitudinal axis of said body, said bridge being arranged to support one end portion of a string at a top surface thereof;

an anchor member mounted on an upper surface of a rear end portion of said bridge base and movable along a direction generally towards said body and, along a direction generally away from said body, said anchor member being arranged to lock a bead coupled to one end of the string; and a tuning bolt for moving said anchor member along, said directions generally towards said body and generally away from said body, the upper surface of the rear end portion of said bridge base being provided with a guide for guiding said anchor member, the guide being inclined at a predetermined angle with respect to said longitudinal axis of said body, said predetermined angle substantially coinciding with a holding angle at one end portion of the string.

2. An apparatus according to claim 1, wherein said bridge is moved in the back-and-forth direction by a pitch bolt inserted in a hole formed in a front wall of the front end portion of said bridge base and horizontally screwed in said bridge.

3. An apparatus according to claim 2, wherein a height adjusting screw is vertically screwed in said bridge, and has a lower end engaged with a guide groove formed on a surface of said bridge base along a string extension direction.

4. An apparatus according to claim 1, wherein the axial center of said tuning bolt substantially aligns with said holding angle at said one end portion of said string.

5. An apparatus according to claim 1, wherein said anchor member is slidably fitted in said guide which has a substantially T-shaped cross section and extends along a string extension direction.

6. An apparatus according to claim 1, which further comprises a neck portion having a fingerboard, said fingerboard having an expanded central portion when viewed along a cross section thereof, a plurality of strings being strung on said neck portion along said expanded central portion, and wherein heights of anchor members on said bridge base with respect to the strings are determined.

7. An apparatus according to claim 1, wherein said anchor member has a recess for receiving said bead.

* * * * *

UNITED STATES PATENT AND TRADEMARK OFFICE

CERTIFICATE OF CORRECTION

PATENT NO. : 4,649,789

DATED : 3/17/87

INVENTOR(S) : WADATSU

It is certified that error appears in the above-identified patent and that said Letters Patent is hereby corrected as shown below:

| COLUMN | LINE | DESCRIPTION |
|---|---|---|
| 2 | 55 | delete "θ" insert --8-- |
| 2 | 58 | delete "8" insert --θ-- |

Signed and Sealed this

Twenty-eighth Day of June, 1988

*Attest:*

DONALD J. QUIGG

*Attesting Officer*

*Commissioner of Patents and Trademarks*